US006824006B2

(12) United States Patent
Lambelet, Jr.

(10) Patent No.: US 6,824,006 B2
(45) Date of Patent: Nov. 30, 2004

(54) CHILD SAFE CONTAINER

(75) Inventor: Lawrence E. Lambelet, Jr., Flemington, NJ (US)

(73) Assignee: Ortho-McNeil Pharmaceutical, Inc., Raritan, NJ (US)

( * ) Notice: Subject to any disclaimer, the term of this patent is extended or adjusted under 35 U.S.C. 154(b) by 0 days.

(21) Appl. No.: 10/289,824

(22) Filed: Nov. 7, 2002

(65) Prior Publication Data

US 2004/0089668 A1 May 13, 2004

(51) Int. Cl.[7] ..... B65D 43/14
(52) U.S. Cl. ..... 220/835; 215/201; 16/361
(58) Field of Search ..... 220/283, 835, 220/811, 812, 813, 324, 326; 16/361, 362; 206/538, 528–531; 215/201, 216, 225, 213, 224

(56) References Cited

U.S. PATENT DOCUMENTS

| | | | | | |
|---|---|---|---|---|---|
| 3,294,222 | A | * | 12/1966 | Hodgson | 206/534.1 |
| 3,437,236 | A | | 4/1969 | Huck | |
| 3,557,747 | A | | 1/1971 | Rigney et al. | |
| 3,558,003 | A | | 1/1971 | Jones | |
| 3,572,282 | A | | 3/1971 | Tump et al. | |
| 3,749,230 | A | * | 7/1973 | Foster | 206/1.5 |
| 3,765,578 | A | * | 10/1973 | Stull | 222/546 |
| 6,845,872 | | * | 11/1974 | Towns et al. | 215/224 |
| 3,907,103 | A | * | 9/1975 | Shaw | 206/1.5 |
| 3,923,180 | A | * | 12/1975 | Fields | 215/216 |
| 3,954,179 | A | * | 5/1976 | Warmath | 206/528 |
| 4,165,709 | A | | 8/1979 | Studer | |
| 4,219,116 | A | * | 8/1980 | Borkan | 206/1.5 |
| 4,511,032 | A | | 4/1985 | Bush | |
| 4,646,936 | A | | 3/1987 | Frazier et al. | |
| 4,667,845 | A | | 5/1987 | Frazier et al. | |
| 4,706,815 | A | | 11/1987 | Curtis et al. | |
| 4,915,256 | A | | 4/1990 | Tump | |
| 5,346,069 | A | * | 9/1994 | Intini | 206/531 |
| 5,551,597 | A | | 9/1996 | Lambelet, Jr. et al. | |
| 5,562,231 | A | | 10/1996 | Lambelet, Jr. et al. | |
| 5,570,810 | A | | 11/1996 | Lambelet, Jr. et al. | |
| 5,664,697 | A | | 9/1997 | Lambelet, Jr. et al. | |
| 5,775,536 | A | | 7/1998 | Lambelet, Jr. et al. | |
| 5,799,821 | A | | 9/1998 | Lambelet, Jr. et al. | |
| 5,878,878 | A | | 3/1999 | Wu | |
| 5,887,736 | A | * | 3/1999 | Mar | 215/213 |
| 5,975,347 | A | | 11/1999 | Lambelet, Jr. et al. | |
| 6,039,208 | A | | 3/2000 | Lambelet, Jr. | |
| 6,138,866 | A | | 10/2000 | Lambelet, Jr. et al. | |
| 6,173,838 | B1 | * | 1/2001 | Brozell | 206/538 |

FOREIGN PATENT DOCUMENTS

| | | |
|---|---|---|
| GB | 595560 | 12/1947 |

OTHER PUBLICATIONS

PCT International Search Report, PCT/US03/35467 dated Apr. 27, 2004.

* cited by examiner

*Primary Examiner*—Lien Ngo

(57) ABSTRACT

A child safe container including a base and a cover is provided. The container includes a hinge and latch which cooperate to maintain the container in a locked position. The container is unlocked and can be opened by translating the base and the cover in a preferred direction.

7 Claims, 11 Drawing Sheets

14
20
16
18
10
28
22
25
24
9
20
26
9
12

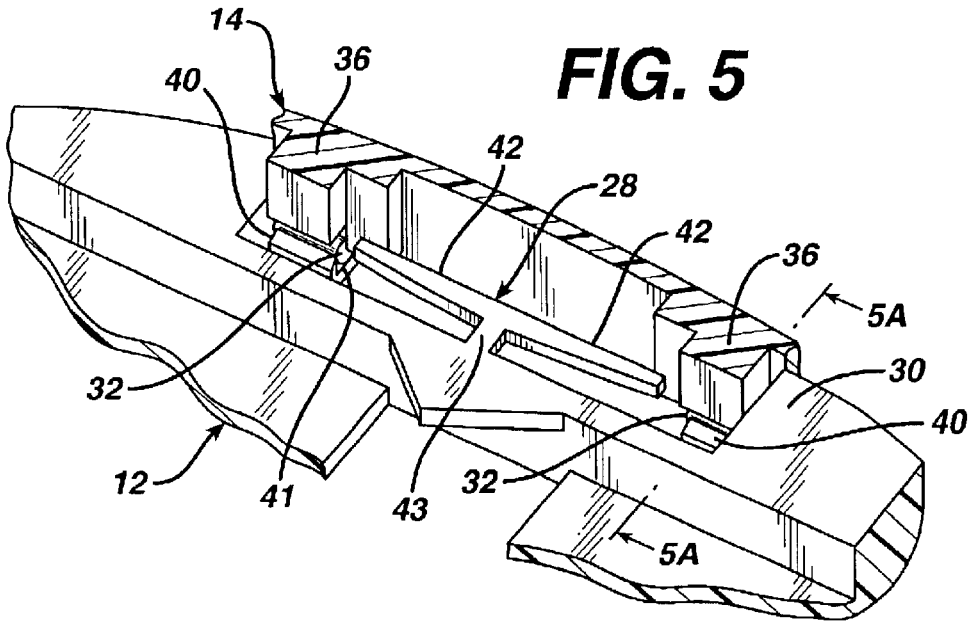
FIG. 5
FIG. 5A
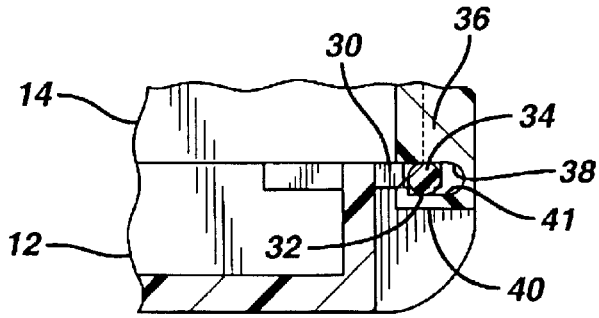

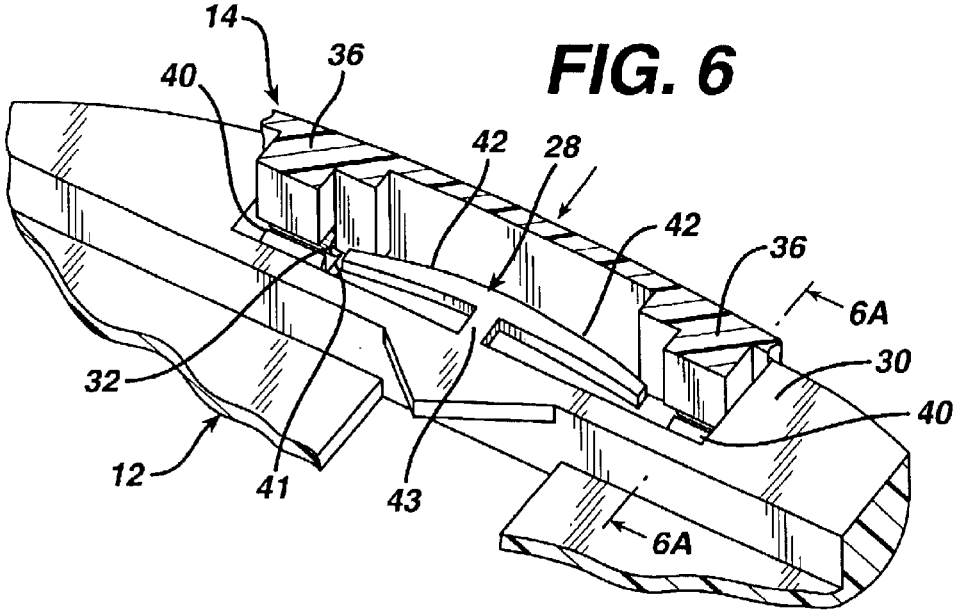
FIG. 6
FIG. 6A
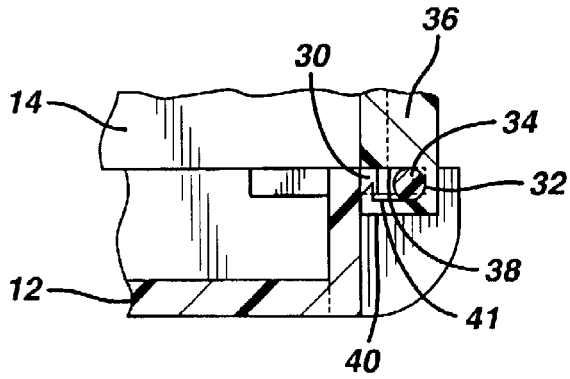

CHILD SAFE CONTAINER

BACKGROUND OF THE INVENTION

Child Resistant (CR) packages, pursuant to the Poison Prevention Packaging Act of 1970, fall into three broad categories: Vials or bottles with a CR cap or closure; blister packs with a removable barrier over the frangible lidding; and, pouches with tear-resistant material and concealed tear-notches. To qualify for a CR package under 16 CFR §'s 1700–1702, the package must undergo a test protocol. It is generally regarded, however, that packages which feature one or more of the following attributes would probably pass the protocol: A cognitive step, a sequence of steps, some dependence upon written instructions, or some strength or dexterity uncommon to children age 5 or below.

In recent years, requirements for Senior Friendly (SF) packaging have been added to the regulations. A package is considered to be Senior Friendly if it can be opened by a test panel in the age group 50–70. This age group is more likely than other adults to have medications in the home, and certain packages such as "push-down-and-turn" or "squeeze-and-turn" caps can be difficult to operate for someone with an arthritic condition. This difficulty would probably result in disabling the CR feature and ultimately defeating the purpose intended.

Some drug packages are exempted. The most notable example is packaging for oral contraceptives. Not only are the hormonal ingredients not particularly toxic to children, the typical configuration of a blister package permits only one-at-a-time dispensing which makes it more difficult to amass a harmful amount of drug. A particular oral contraceptive package known in the art provides other desirable functions and features. These include day, date or other indicia, a resettable start day for the regimen, a memory-aid to assist schedule compliance, a one-way advancement mechanism for indexing next dose, a single dispensing aperture to assure purposeful selection of the dose, and a protective case to safeguard the contents.

A commonly used oral contraceptive container providing many of the features and functions noted above has a compact design and includes a rotating, ratcheted "dial", and a means to receive a blister containing a circular array of tablets in a unique orientation to the indicia and to the dispensing aperture. Typically, such a container has a body and a lid, or cover, connected by a hinge.

It would be desirable for drugs other than oral contraceptives to have such compliance and protection functionality. Drugs for chronic treatments and titration regimens where sequence and timing are critical are but two such examples. There are few, if any, such packages, however, which are also CR/SF. The present invention is directed to a CR/SF solution for a hinged-lid container. It relies on a cognitive step and an adult hand-span to achieve a safety profile with children. The cognitive step can be communicated in written instructions to adults, or may otherwise be intuitive to someone with broad experience, uncommon to children, in handling packages. The Senior Friendly claim is based on simple two-step operation combined with a diminutive hand-pressure requirement to open.

SUMMARY OF THE INVENTION

The present invention provides a child-safe container including a base shaped as an open-topped housing which supports a pivot defining a pivot axis. The container further includes a cover rotatably attached to the base by a hinge, such that an opening direction is defined by rotation of the base and cover about the pivot axis. The base and the cover are also translatable relative to one another in one or more preferred directions other than the opening direction. A means for latching and unlatching the cover is also provided. The means for latching and unlatching is operable exclusively in the preferred directions.

In one preferred embodiment, the child-safe container includes a base and a cover with side walls attached to at least one of the base and cover such that an interior space is enclosed. The base and cover are rotatably connected at a hinge having first and second members forming the joint. One of the members defines one or more slots while the other member defines one or more corresponding hinge pins. The hinge pin has a pin axis, serving as the pivot, and the pin is moveably retained within the slot of the other member such that translational movement back and forth is allowed in a preferred direction. The container also includes a latch having one or more pairs of interlocking surfaces supported by first and second bosses. These bosses form the connecting structures to the base and cover. The interlocking surfaces have the capability to move between locked and bypass positions relative to one another. The location of the bosses and the juxtaposition of the interlocking surfaces prevent rotation about the pivot in the locked position. Alternatively, rotation about the pivot is freed at the bypass position. The container further includes an attached spring interposed between the base and cover such that the latch is biased by the spring in the locked position. When a force is applied at the hinge in the preferred direction, the articulation of the hinge allows the latch to attain the bypass position where freedom to pivot the base and cover open gives access to the interior space.

In one particularly preferred embodiment, the preferred direction operates in a plane containing the pin axis and in a direction perpendicular to this axis. Pressure applied at the hinge slides the cover forward relative to the base and exposes a front edge useful in lifting the cover. In this case, the pin axis moves relative to the slot. A cut away section in the cover allows counter pressure to be applied to the base without interference as the cover slides forward.

In another particularly preferred embodiment, the preferred direction also operates in a plane containing the pin axis but in a direction parallel to this axis. Opposing tabs attached to the hinge members provide leverage points for a squeezing force. This force reconfigures the hinge along the pin axis. This reconfiguration moves the cover sideways relative to the base and exposes a side edge to facilitate lifting. In this case, while the hinge pin itself moves, the pin axis remains stationary relative to the slot.

BRIEF DESCRIPTION OF THE DRAWINGS

FIG. 5 is a top perspective partial view of the hinge and spring at the locked position.

FIG. 5A is a cross-sectional partial view of the hinge and spring at the locked position.

FIG. 6 is a top perspective partial view of the hinge and spring at the bypass position.

FIG. 6A is a cross-sectional partial view of the hinge and spring detail at the bypass position.

DETAILED DESCRIPTION OF THE PREFERRED EMBODIMENTS

Figure 1:
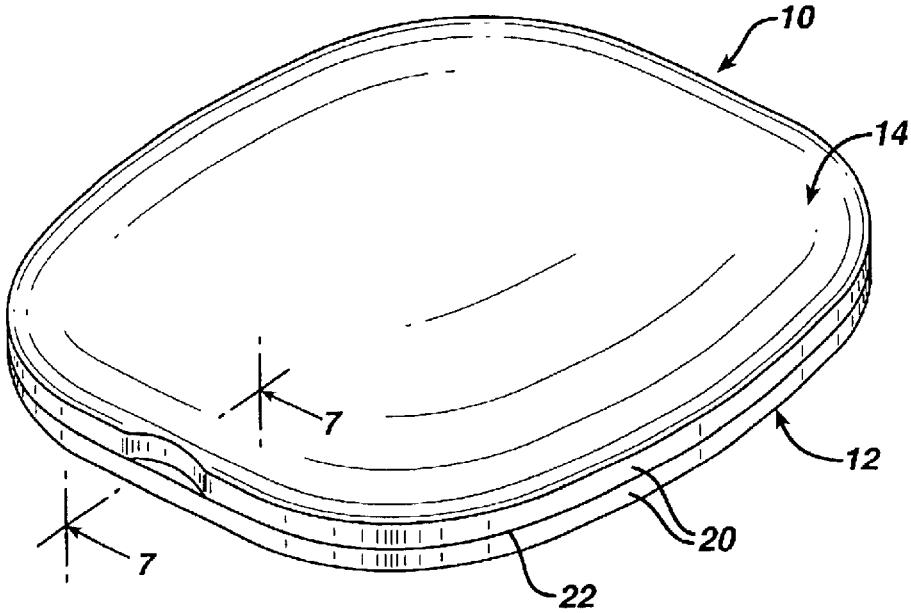
FIG. 1 is a top perspective view of the closed preferred embodiment of a child-safe container.
Figure 2:
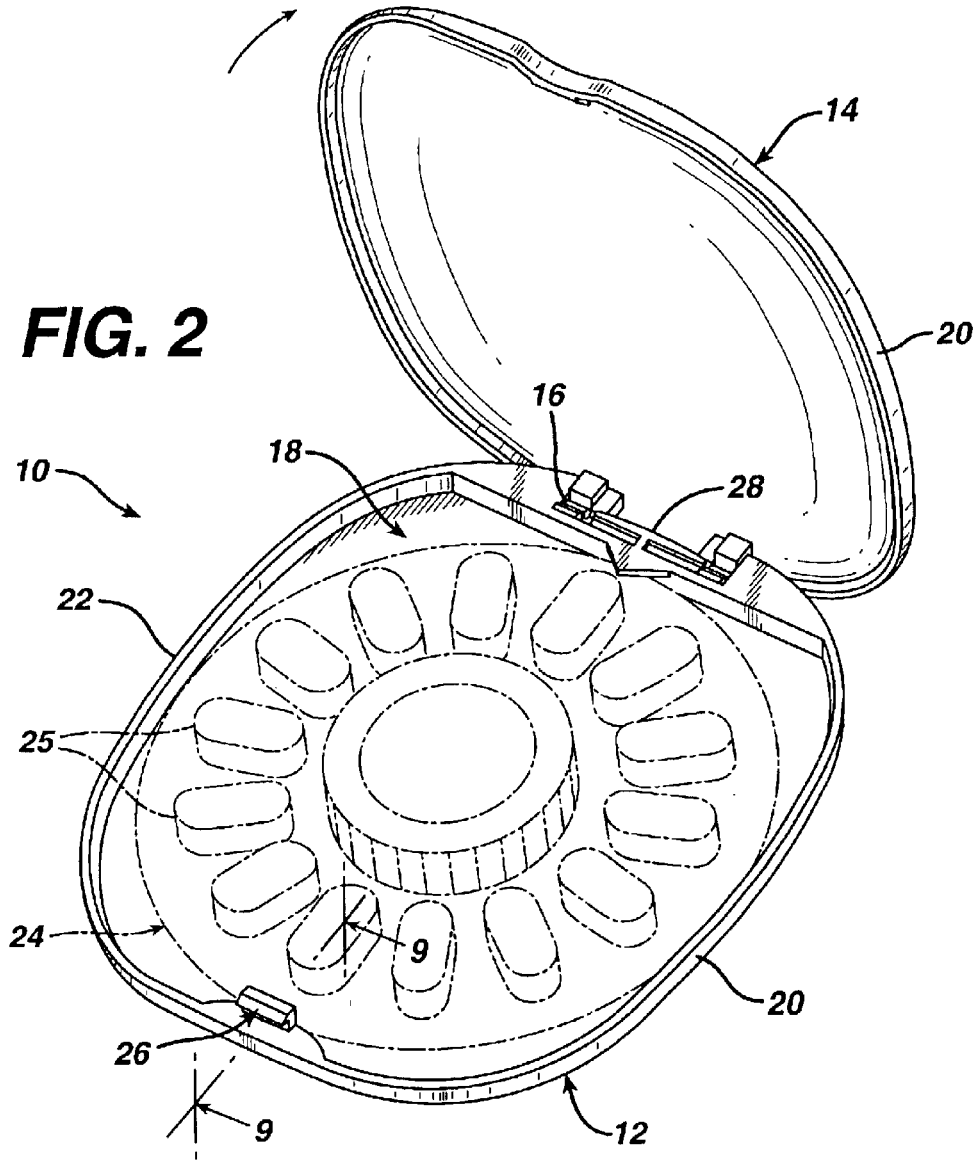
FIG. 2 is a perspective view of the opened container showing contents as well as latch and hinge detail.

One preferred embodiment of the child safe container of the invention is illustrated in FIGS. 1–11 with reference to such figures and the numbers provided therein. Referring first to FIGS. 1 and 2, the child safe container, generally designated 10, includes a base 12 and a cover 14. A hinge, generally designated 16, rotatably connects the base 12 and cover 14. An interior space 18 is defined by side walls 20, which are attached to base 12 and cover 14 with a separating partition at parting line 22. The partitioning forms an open-topped housing of base 12 and side walls 20. The contents of the child safe container are shown as pill package 24 that includes a plurality of pills or tablets 25, 25. A latch, generally designated 26, alternatively locks and unlocks the assembly to provide access to pill package 24. A spring, generally designated 28, biases the assembly in the locked position when closed.

Figure 3:
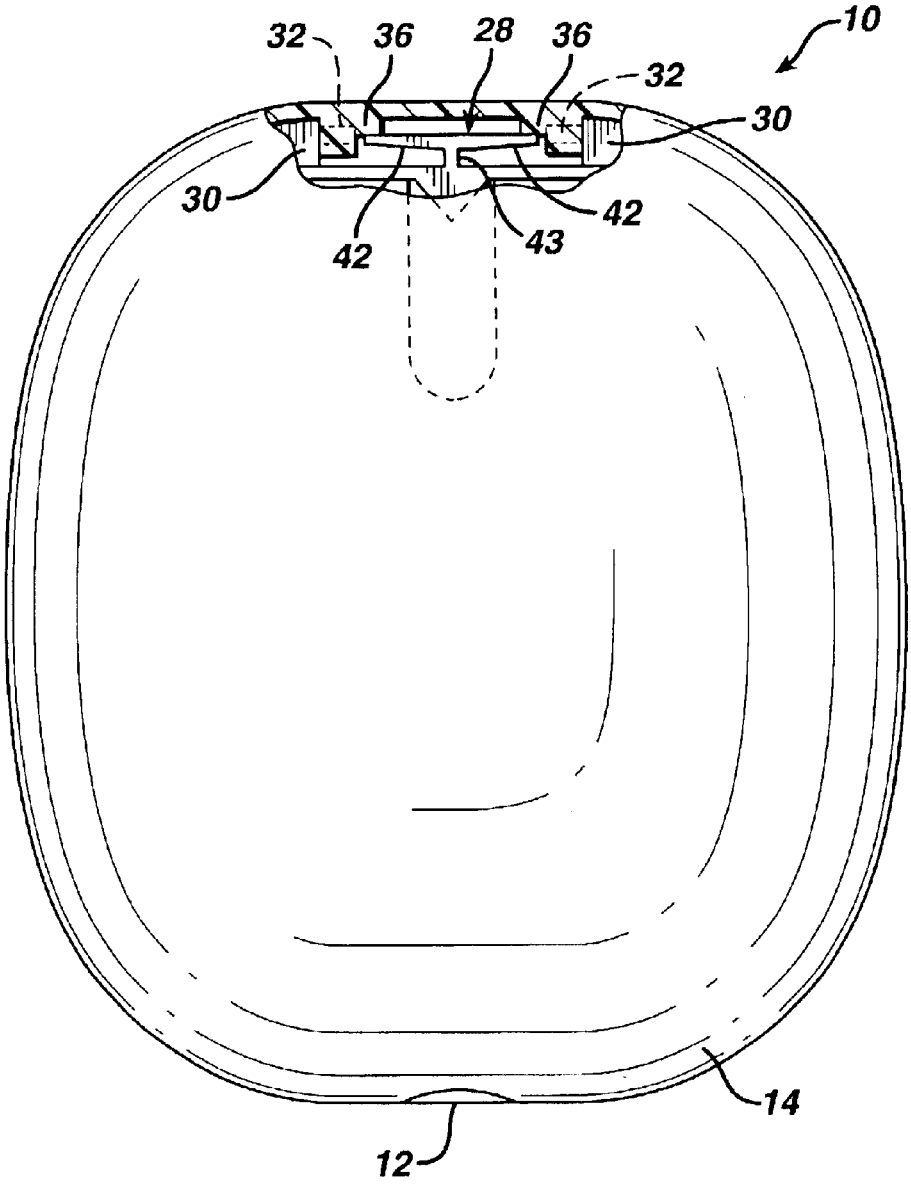
FIG. 3 is a plan top view of the closed container with a cut away view showing hinge and spring detail at the locked position.
Figure 4:
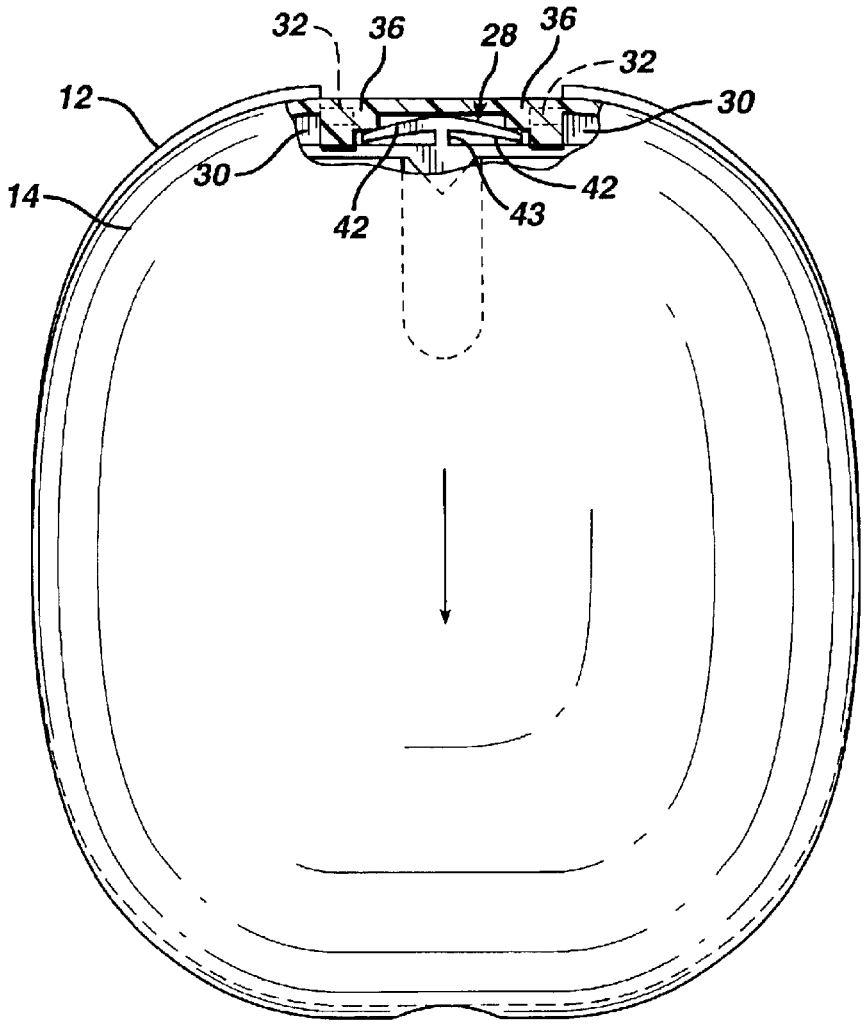
FIG. 4 is a plan top view of the closed container with a cut away view showing hinge and spring detail at the bypass position.

Referring to FIGS. 3–6A, further details of the hinge 16 and spring 28 are illustrated. FIGS. 3, 5 and 5A show these features at a rest position corresponding to a locked position, while FIGS. 4, 6 and 6A illustrate them in a articulated position corresponding to a bypass position. Both the locked position and the bypass position will be recited in following paragraphs. A first hinge member 30, shown attached to the base 12, supports a pair of hinge pins 32. The hinge pins 32 are positioned on coincident centerlines, which define a pin axis 34. A second hinge member 36, shown attached to cover 14, fits inside first hinge member 30 and supports a pair of slots 38. The hinge pins 32 are held captive within slots 38 by tangs 40, which are connected to second hinge member 36. Tangs 40 have top surfaces 41 in sliding contact with hinge pins 32. Top surfaces 41 define a plane parallel to the plane defined by curved parting line 22.

First hinge member 30 is capable of sliding into second hinge member 36 such that hinge pins 32 move within slots 38 between a rest position and an articulated position. The rest position corresponds to location of the hinge pins at the distal end of slots 38, as shown in FIG. 5A. Compare FIG. 6A, where the articulated position corresponds to location at the proximal end of slots 38. The preferred direction is thus described by the movement of the hinge pins 32 as they move from the rest position to the articulated position. In this particular preferred embodiment, the preferred direction is perpendicular to pin axis 34 and lies in a plane parallel to top surfaces 41. Rotational motion of the cover 14 about pin axis 34, wherein a pivot is defined, is enabled by the symmetry of the diametral contact points where hinge pins 32 and the slots 38 interface.

Referring more particularly now to spring 28, shown best in FIGS. 3 and 5, the spring is shaped like a "T" with flexible beams 42 forming the top part of the T and stem 43 forming an attachment to base 12. The flexible beams 42 bear upon second hinge member 36 in a way to urge cover 14 toward the rest position. When pressure is applied to hinge 16 in the preferred direction, the flexible beams 42 are bent in an arch, thereby creating a tension force. Stem 43 has sufficient extent to allow flexible beams 42 to bend inward to a configuration corresponding to the articulated position, as shown in FIGS. 4 and 6. The tension in flexible beams 42 is sufficient to return the cover to the rest position when the pressure is relieved.

Figure 7:
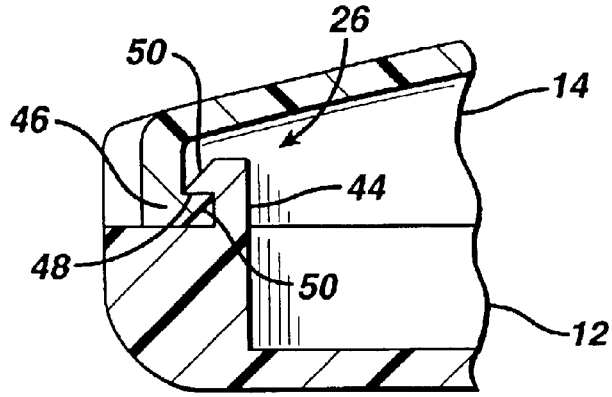
FIG. 7 is a cross-sectional view of the closed container showing latch detail in a locked position.
Figure 8:
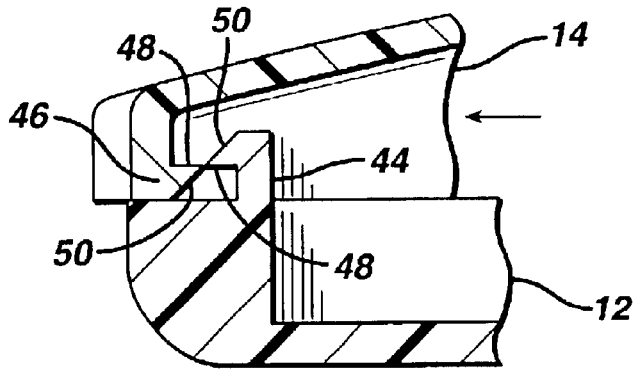
FIG. 8 is a cross-sectional view of the closed container showing latch detail in a bypass position.
Figure 9:
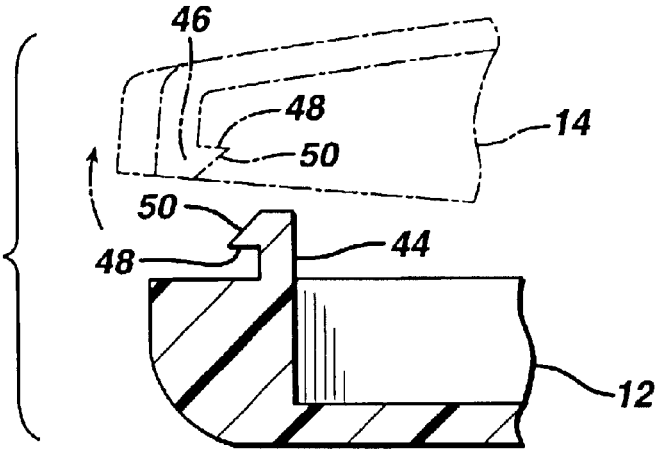
FIG. 9 is a cross-sectional view of the container during opening.

Referring next to FIGS. 7–9, further details of latch 26 can be observed. A first boss 44 is attached to base 12 and a second boss 46 is attached to cover 14. The interface of first boss 44 and second boss 46 defines a pair of interlocking surfaces 48. Interlocking surfaces 48, in turn, define a pair of planes parallel to the plane of top surfaces 41 and the plane of parting line 22. Interlocking surfaces 48 slide in these planes between a locking position, where the surfaces are in contact, and a bypass position, where the surfaces are parted. Because interlocking surfaces 48 are rigidly attached to elements of hinge 16 by commonality with cover 14 and base 12, and because motion in the preferred direction is guaranteed by parallelism, the locking position of latch 26 can correspond to the rest position of hinge 16, and the bypass position, similarly, can correspond to the articulated position. In this manner, a pressure applied at hinge 16 can actuate latch 26 with the consequence that cover 14 can then be rotated open to access interior space 18. The locking position is shown in FIG. 7 and the bypass position is shown in FIG. 8. FIG. 9 shows the cover opening.

First boss 44 and second boss 46 also define a pair of camming surfaces 50. These surfaces, also shown in FIGS. 7–9, are positioned to come into contact when cover 14 is rotated closed upon base 12, and are angled in a manner to cam the cover in the preferred direction relative to the base. Optimum contact of camming surfaces 50 occurs when hinge 16 is in the rest position. This position is attained automatically after opening when the spring responds to the relief of pressure at the hinge. Camming surfaces 50 provide sufficient shift in the preferred direction to sufficiently move interlocking surfaces 48 to the bypass position. This camming motion reconfigures hinge 16 and applies pressure to spring 28. The pressure creates a retracting force in spring 28, which operates to slide cover 14 toward the locked position when bypass is achieved. In the locked position, cover 14 cannot be opened by rotation about the pivot because of interfering geometries between interlocking surfaces 48 and between hinge pins 32 and tangs 40.

Figure 10:
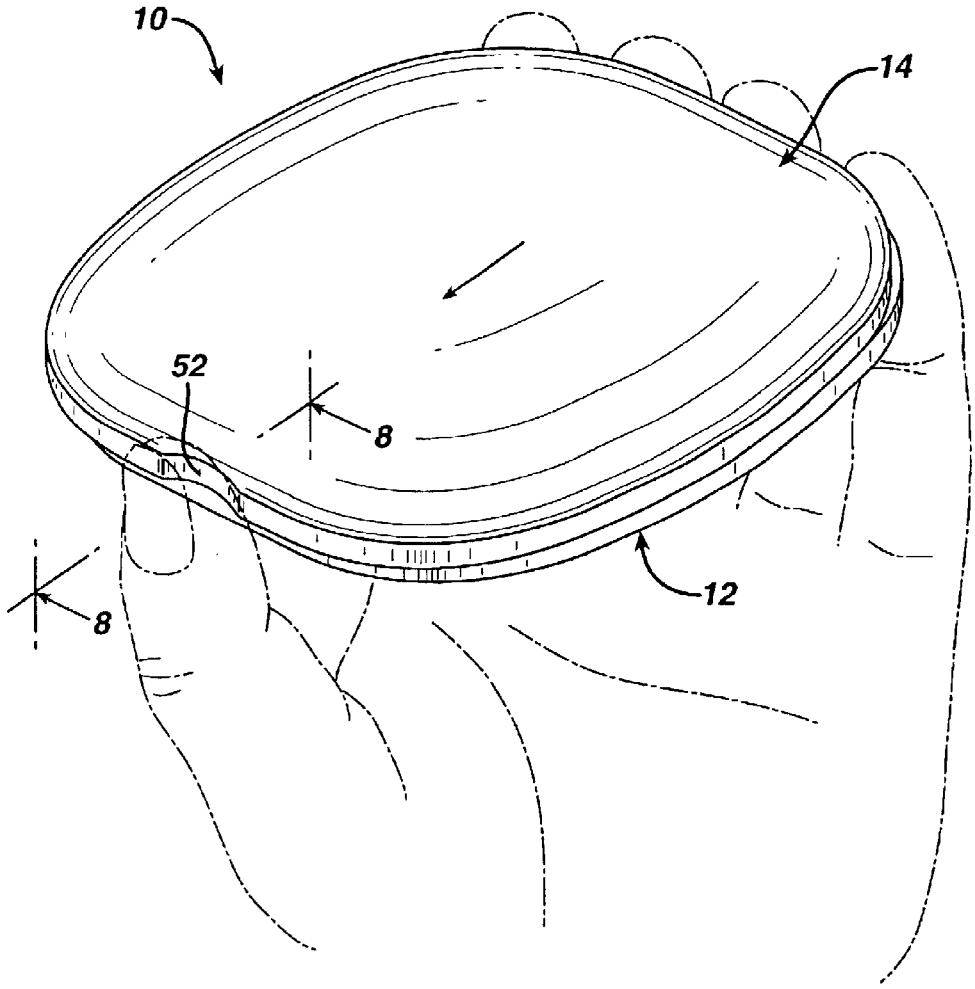
FIG. 10 is a top perspective view of the closed container showing hand position during articulation of the assembly.
Figure 11:
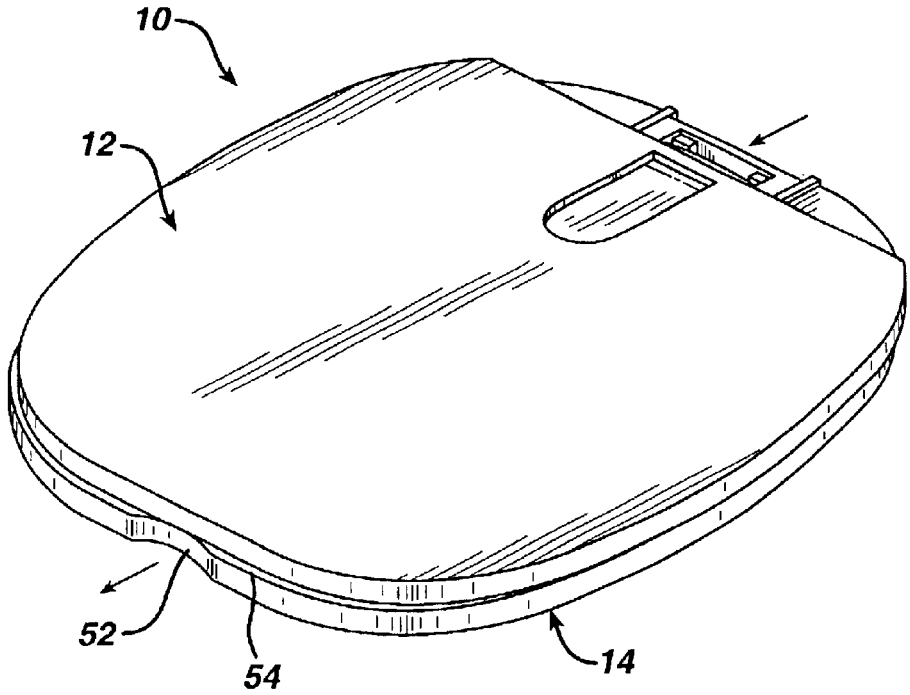
FIG. 11 is a bottom perspective view of the closed container showing articulation of the assembly.

In this particular embodiment, pressure at hinge 16 can be applied by hand in the manner illustrated in FIG. 10. Cover cutaway 52 facilitates a counter-grip by permitting cover 14 to advance without interference from the thumb in the illustration. When the base and cover are advanced to the bypass position, forward edge 54 is exposed. This is best shown in FIG. 11. Forward edge 54 is useful as a leverage point to open cover 14.

Another preferred embodiment of the child safe container of the invention is illustrated in FIGS. 12–15. This embodiment is similar to the previously described embodiment, except in the orientation of the preferred direction and in details of hinge 16 and spring 28. Only the differences will be recited below, with reference to these figures and numbers provided therein.

Figure 12:
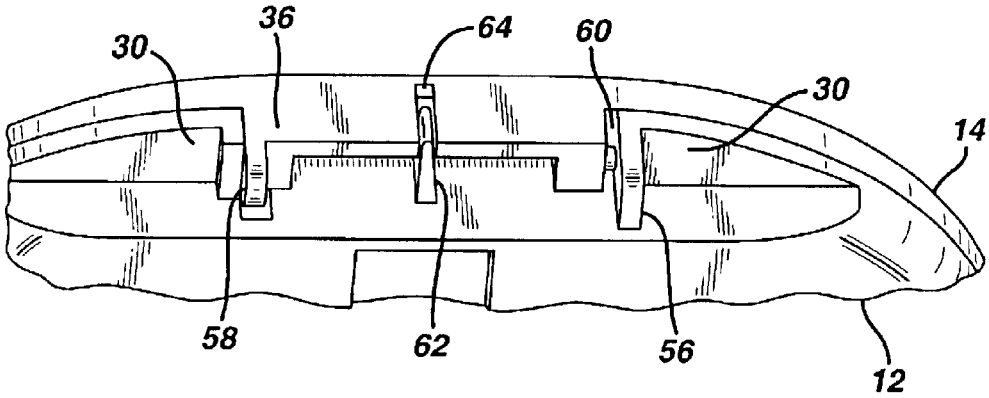
FIG. 12 is a bottom perspective partial view of a second preferred embodiment showing hinge and spring detail at the locked position
Figure 14:
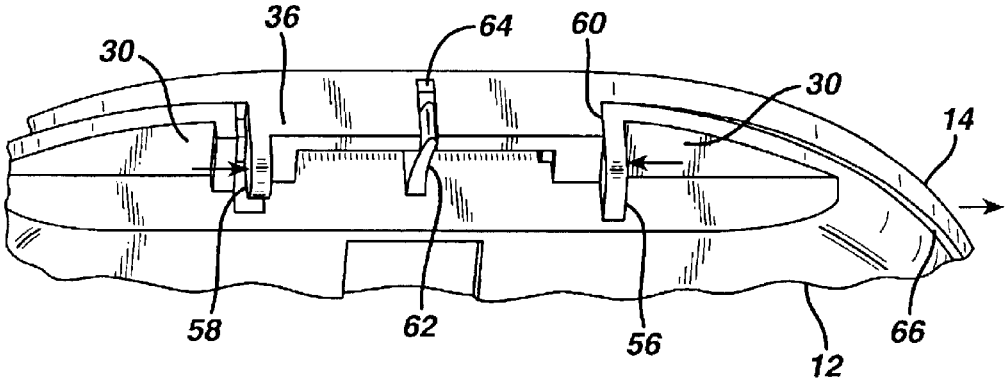
FIG. 14 is a bottom perspective partial view of the second preferred embodiment showing hinge and spring detail at the bypass position.

Elements of hinge 16 and spring 28 are illustrated in FIGS. 12 and 14. First tab 56 extends outward from one side of first hinge member 30 to form a rigid structure sufficient for a handgrip. Second tab 58 extends similarly from second hinge member 36. Gap 60, defined by the space between first hinge member 30 and second hinge member 36, is located between first tab 56 and second tab 58. The breadth of gap 60 corresponds to the distance between the rest position of hinge 16 and the articulated position. The translational movement between the rest position and the articulated position is achieved by squeezing the tabs together and closing gap 60. This moves cover 14 in a direction relative to base 12 which is perpendicular to that of the previous embodiment. Hinge pins 32 now slide in slots 38 with pin axis 34 remaining stationary. This particular preferred embodiment has a preferred direction, defined previously as the movement of any discrete point on hinge pins 32 between rest and articulated positions, parallel, rather than perpendicular, to pin axis 34.

Figure 13:
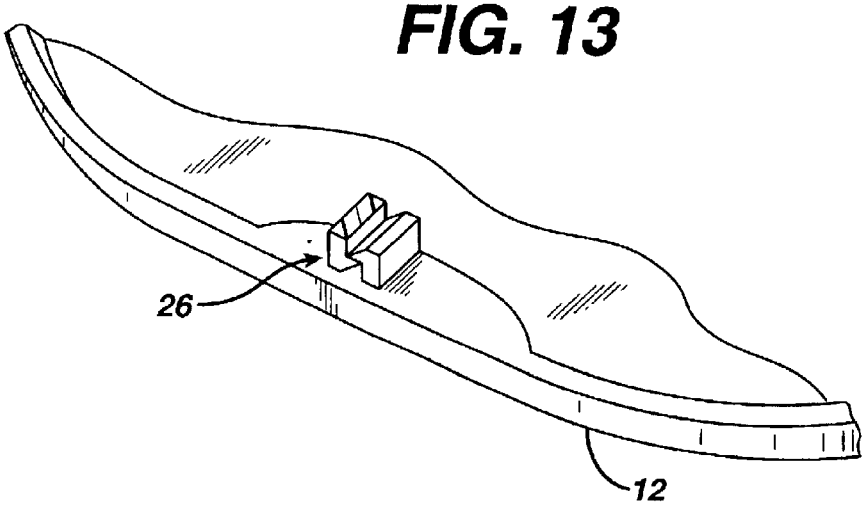
FIG. 13 is top perspective partial view of the second preferred embodiment showing latch detail at the locked position.
Figure 15:
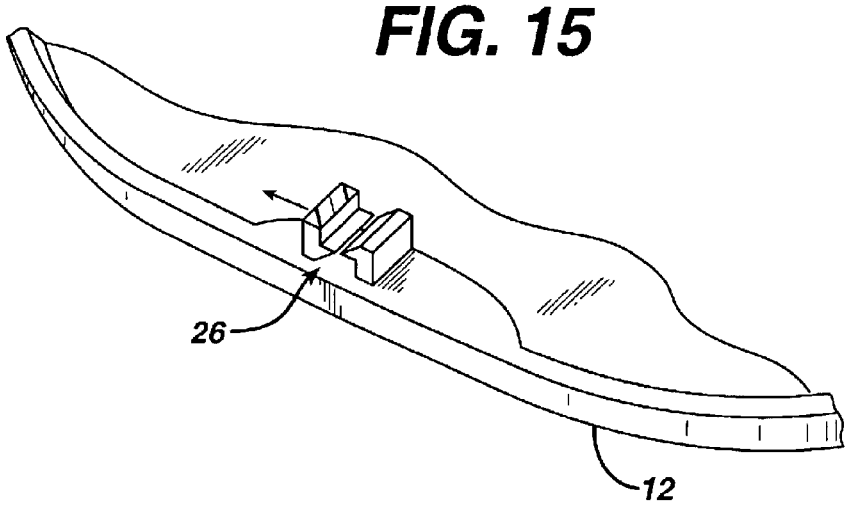
FIG. 15 is a top perspective partial view of the second preferred embodiment showing latch detail at the bypass position.

Spring 28 illustrated in the previous embodiment is redefined as standing beam 62 and is shown in an upright profile attached to base 12. Standing beam 62 is fitted to slot 64 in cover 14. Standing beam 62 and slot 64 are positioned to bias cover 14 to the rest position. When hinge 16 is moved to the articulated position, the translation of slot 64 in the preferred direction bends standing beam 62 and creates the necessary tension to retract the articulated components. The rest position is shown in FIG. 12 and the articulated position, in FIG. 14. FIGS. 13 and 15 show the same contrasting positions for latch 26. In this particular preferred embodiment, latch 26 is rotated 90 degrees from the previous embodiment so that the separation direction corresponds to the preferred direction. Side edge 66, which becomes the new leverage point for opening in this particular preferred embodiment, is illustrated in FIG. 14.

What is claimed is:

1. A child-safe container, comprising:

a base;

a cover;

side walls attached to at least one of said base or said cover inclosing an interior space;

a hinge including a first member supported on one of said base and said cover and a second member supported on the other of said base and said cover, one of said members defining at least one slot and the other of said members supporting at least one hinge pin having a pin axis, said pin being moveably retained within said slot for translation back and forth in a preferred direction, wherein said cover and said base are rotatable relative to one another about the pin axis;

a latch including a first boss supported on one of said base and said cover and a second boss supported on the other of said base and said cover at locations remote from said hinge, said first and second bosses defining one or more pairs of interlocking surfaces movable relative to one another between a locked position and a bypass position; and a spring supported on one of said base and said cover and interposed between said base and said cover so that said spring is tensioned in said bypass position and relaxed in said locked position thereby biasing said base and cover in the locked position;

wherein said hinge, latch, and spring cooperate to prevent access to said internal space until an external force is applied to said hinge in said preferred direction causing said binge pin to articulate in said slot and said interlocking surfaces to part to said bypass position, wherein opening of the container is accomplished by rotation of said cover and base about said pin axis to expose the internal space.

2. The child-safe container of claim 1 wherein said preferred direction is in a plane containing the pin axis.

3. The child-safe container of claim 2 wherein said preferred direction is perpendicular to the pin axis.

4. The child-safe container of claim 2 wherein said preferred direction is parallel to the pin axis.

5. The child-safe container of claim 1 wherein translation of the base and the cover between the locked and the bypass positions provides exposure of an edge on one of said base and said cover for hand positioning during opening.

6. The child-safe container of claim 3 wherein one of said cover and said base defines a cutaway portion which permits a hand-hold grip during the transition of said base and said cover from said locked position to said bypass position.

7. The child-safe container of claim 4 wherein said cover and said base each support one of a pair of tabs positioned to facilitate the application of a squeezing force to said hinge during the transition of said base and said cover from said locked position to said bypass position.

* * * * *